US006609852B2

(12) United States Patent
Wimberger

(10) Patent No.: US 6,609,852 B2
(45) Date of Patent: Aug. 26, 2003

(54) SEDIMENT CONTROL DRAIN AND METHOD OF CONSTRUCTION

(75) Inventor: Brian J. Wimberger, 817-12th Ave. SE., Apt. 301, Minneapolis, MN (US) 55401

(73) Assignee: Brian J. Wimberger, Skakopee, MN (US)

( * ) Notice: Subject to any disclaimer, the term of this patent is extended or adjusted under 35 U.S.C. 154(b) by 0 days.

(21) Appl. No.: 09/756,565

(22) Filed: Jan. 8, 2001

(65) Prior Publication Data

US 2002/0090267 A1 Jul. 11, 2002

(51) Int. Cl.[7] ..... E02B 11/00; E01F 5/00; E01C 11/22

(52) U.S. Cl. ..... 405/40; 405/36; 405/41; 405/48; 405/52; 404/2; 404/5; 210/170; 210/163

(58) Field of Search ..... 405/36, 39, 40, 405/41, 43, 45, 46, 48, 52, 53, 118; 404/2–5; 210/163–166, 532.1

(56) References Cited

U.S. PATENT DOCUMENTS

| | | | | | |
|---|---|---|---|---|---|
| 693,511 | A | * | 2/1902 | Garrett et al. | 210/163 |
| 810,879 | A | | 1/1906 | Perry | |
| 902,289 | A | | 10/1908 | Gribben et al. | |
| 1,141,678 | A | | 6/1915 | Bailey | |
| 1,457,637 | A | | 6/1923 | Sievers | |
| 1,541,436 | A | | 6/1925 | Reshan | |
| 1,601,498 | A | | 9/1926 | Hirshstein | |
| 1,711,674 | A | * | 5/1929 | Egan | 210/163 |
| 1,812,583 | A | | 6/1931 | Cavalieri | |
| 1,993,534 | A | | 3/1935 | Stoltz | |
| 2,182,795 | A | | 12/1939 | Day | |
| 3,246,582 | A | | 4/1966 | Wade et al. | |
| 3,439,505 | A | | 4/1969 | Martin | |
| 3,665,526 | A | | 5/1972 | Hoffman | 4/287 |
| 3,695,153 | A | * | 10/1972 | Dorris | 404/4 |
| 4,345,998 | A | * | 8/1982 | Graffis et al. | 210/164 |
| 4,419,232 | A | * | 12/1983 | Arntyr et al. | 210/164 |
| 5,032,264 | A | * | 7/1991 | Geiger | 210/163 |
| 5,297,895 | A | * | 3/1994 | Johnson | 405/41 |
| 5,383,318 | A | | 1/1995 | Kelley et al. | 52/287.1 |
| 5,403,474 | A | * | 4/1995 | Emery | 210/163 |
| 5,582,720 | A | | 12/1996 | Deming | 210/164 |
| 5,744,048 | A | * | 4/1998 | Stetler | 210/164 X |
| 5,843,306 | A | * | 12/1998 | Singleton | 210/163 |
| 5,849,198 | A | * | 12/1998 | Sharpless | 210/163 X |
| 5,954,952 | A | * | 9/1999 | Strawser, Sr. | 210/164 |
| 5,980,740 | A | * | 11/1999 | Harms et al. | 210/162 |
| 6,062,767 | A | * | 5/2000 | Kizhnerman et al. | 405/39 |
| 6,287,459 | B1 | * | 9/2001 | Williamson | 210/164 X |
| 6,306,293 | B1 | * | 10/2001 | Schilling et al. | 210/164 |

FOREIGN PATENT DOCUMENTS

| | | | | |
|---|---|---|---|---|
| GB | 2217364 | * | 10/1989 | 404/4 |

OTHER PUBLICATIONS

Wimco Road Drain Brochure; Portion identified as "Road Drain Top Slab" only admitted prior art disclosure published prior to Jan. 1, 2000.

* cited by examiner

*Primary Examiner*—Jong-Suk James Lee
(74) *Attorney, Agent, or Firm*—Westman, Champlin & Kelly, P.A.

(57) ABSTRACT

An erosion control basin is a molded open topped receptacle that has support flanges that will support the basin on the interior of a storm drain grate frame. A filter is formed around an upright perforated drain pipe that is on the interior of the basin and which opens to an outlet. The basin catches debris and silt but permits water to drain out. The top of the drainpipe is left open for overflow purposes.

12 Claims, 3 Drawing Sheets

SEDIMENT CONTROL DRAIN AND METHOD OF CONSTRUCTION

Sediment Control Drain and Method of Construction

BACKGROUND OF THE INVENTION

The present invention relates to an erosion control basin and drain that is used during construction for preventing debris and sediment from entering the storm sewer. A basin that is provided will fit into a frame that will be used for the normal storm sewer drain grate, and will provide for catching debris, yet permitting water to be drained out.

Presently, when road and utility construction is undertaken, particularly in new building developments, a frame is put into place at storm sewer drains that are along the curb and gutters of streets. These frames are mounted onto the storm sewer stand pipes that have been previously installed, and in the normal process, the gutters are then formed around these frames. The curb and gutter around the grate and the curb box are generally hand formed, and during this process waste concrete that may be troweled off during finishing, or dropped, will enter the storm sewer structure, and it must be removed at the end of the installation. Additionally, during construction, particularly in new developments, if heavy rains occur, a large amount of debris and silt will be washed into the storm sewers all to the detriment of environmental conditions.

It is, however, during the forming of the curb and gutter around the storm sewer grate and frame that when concrete is most likely to fall into the storm sewer. The present device provides a simple, easily used insert basin and drain to be supported on the frame during construction to catch concrete, and other debris.

SUMMARY OF THE INVENTION

The present invention relates to a drain catch basin formed in a suitable manner, that will fit into a storm sewer drain frame, and which will catch and retain concrete waste, and other debris. The catch basin has a center perforated tube forming a drain tube, that is covered with a filtration sock, or fine mesh, to filter out large debris but yet let water pass through for draining as necessary. The upper opening of the tube, which forms a standpipe type structure, is left open so that in cases where heavy rains or heavy runoff is present, and the water starts to back up, there is a larger opening for permitting draining without flooding the street. Additionally, for overflow, a curb box is provided. The curb box is a frame laterally offset from the grate frame and around which the curb is formed. The curb box forms a passageway which is also open to the storm sewer. The curb box is only partially blocked with a wall of the basin of the present invention, so that there is an open space above the wall to provide for overflow into the curb box.

The basin, with its drain capabilities is left in place until the turf or other landscaping has been established around the curb, and the curb has been formed.

DETAILED DESCRIPTION OF THE PREFERRED EMBODIMENTS

Figure 1:
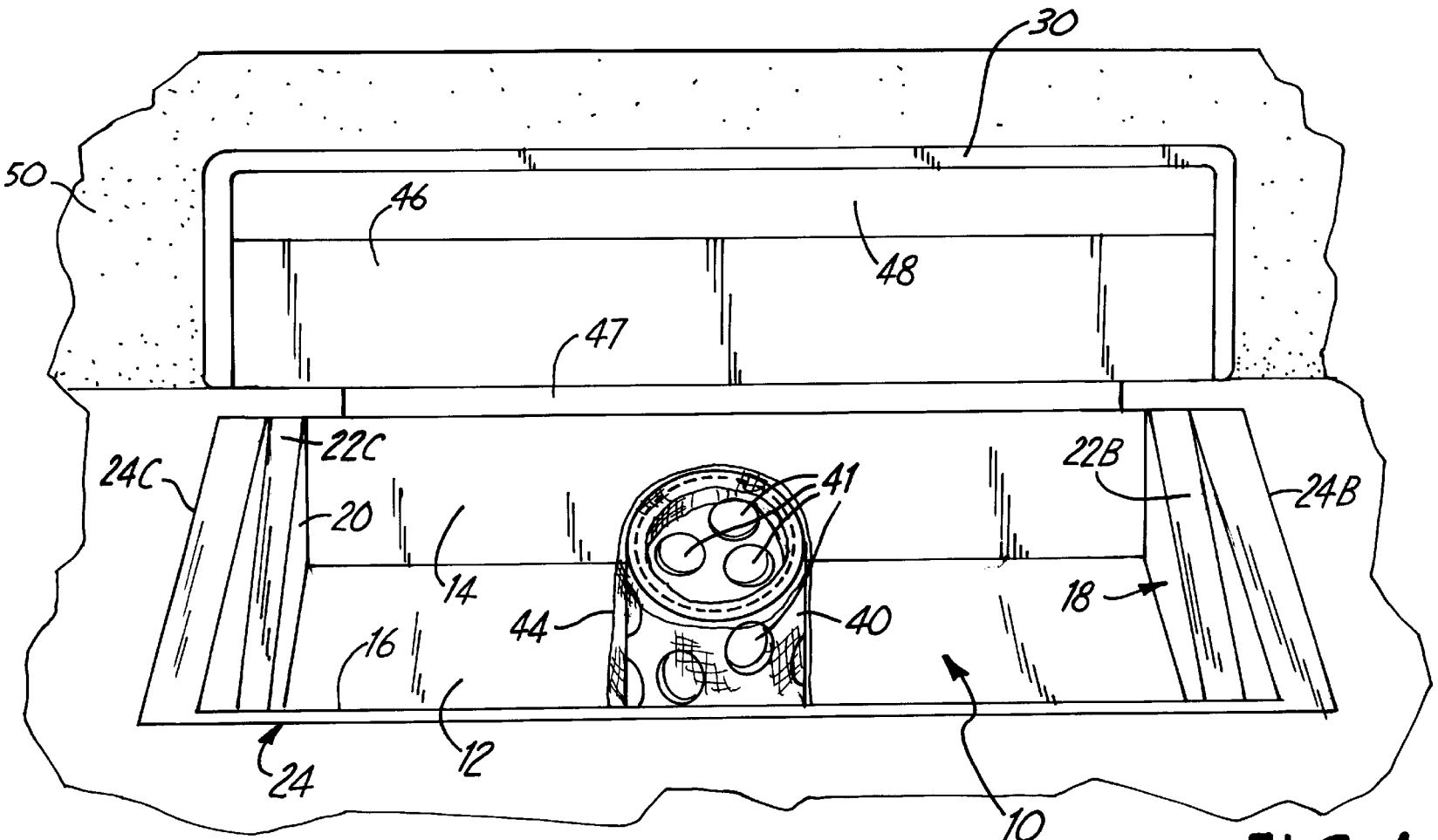
FIG. 1 is a top front perspective view of a catch basin made according to the present invention in a partially installed curb and gutter.
Figure 2:
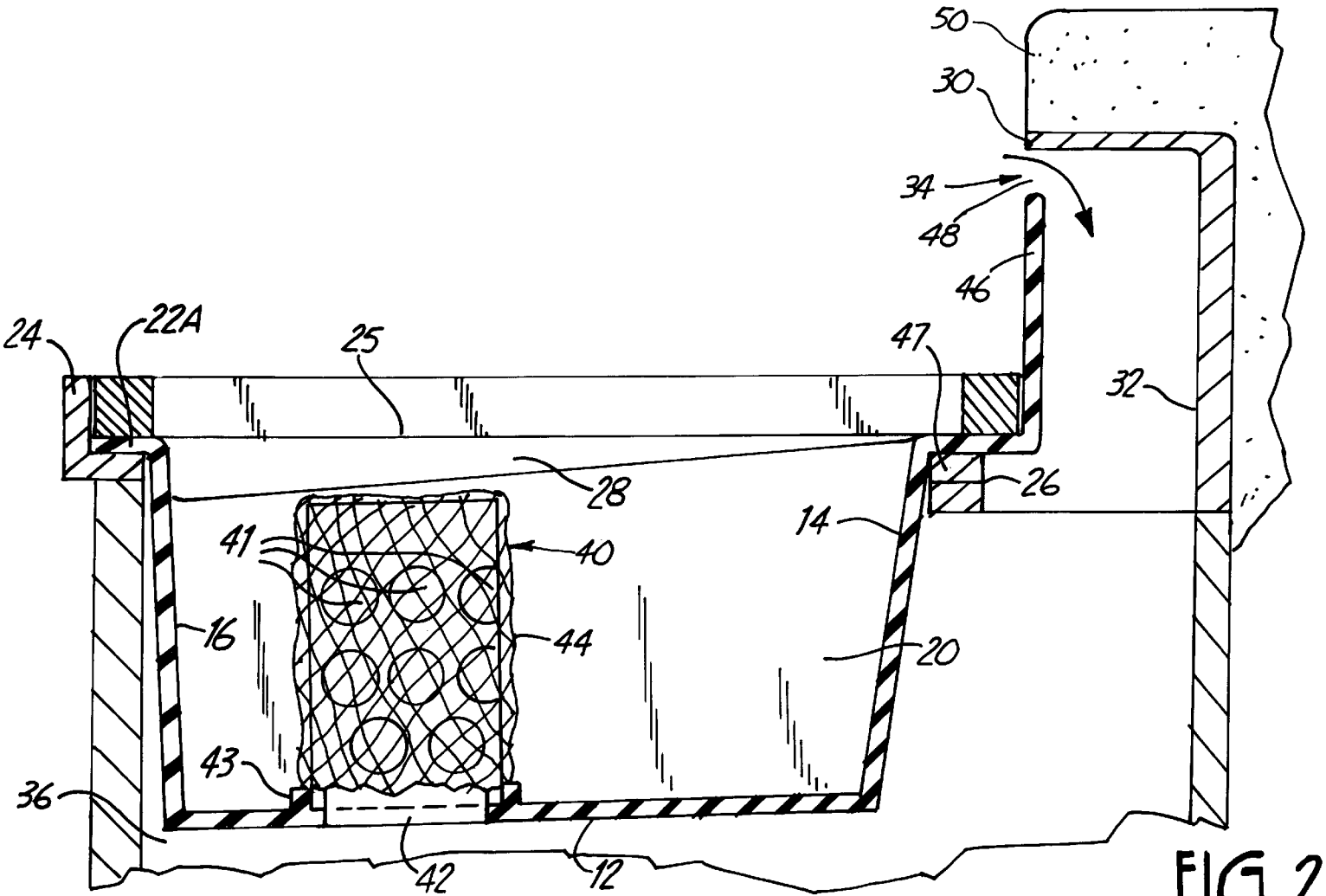
FIG. 2 is a schematic sectional view showing the catch basin installed in a frame, after using a curb box, and after a curb and gutter has been formed.
Figure 3:
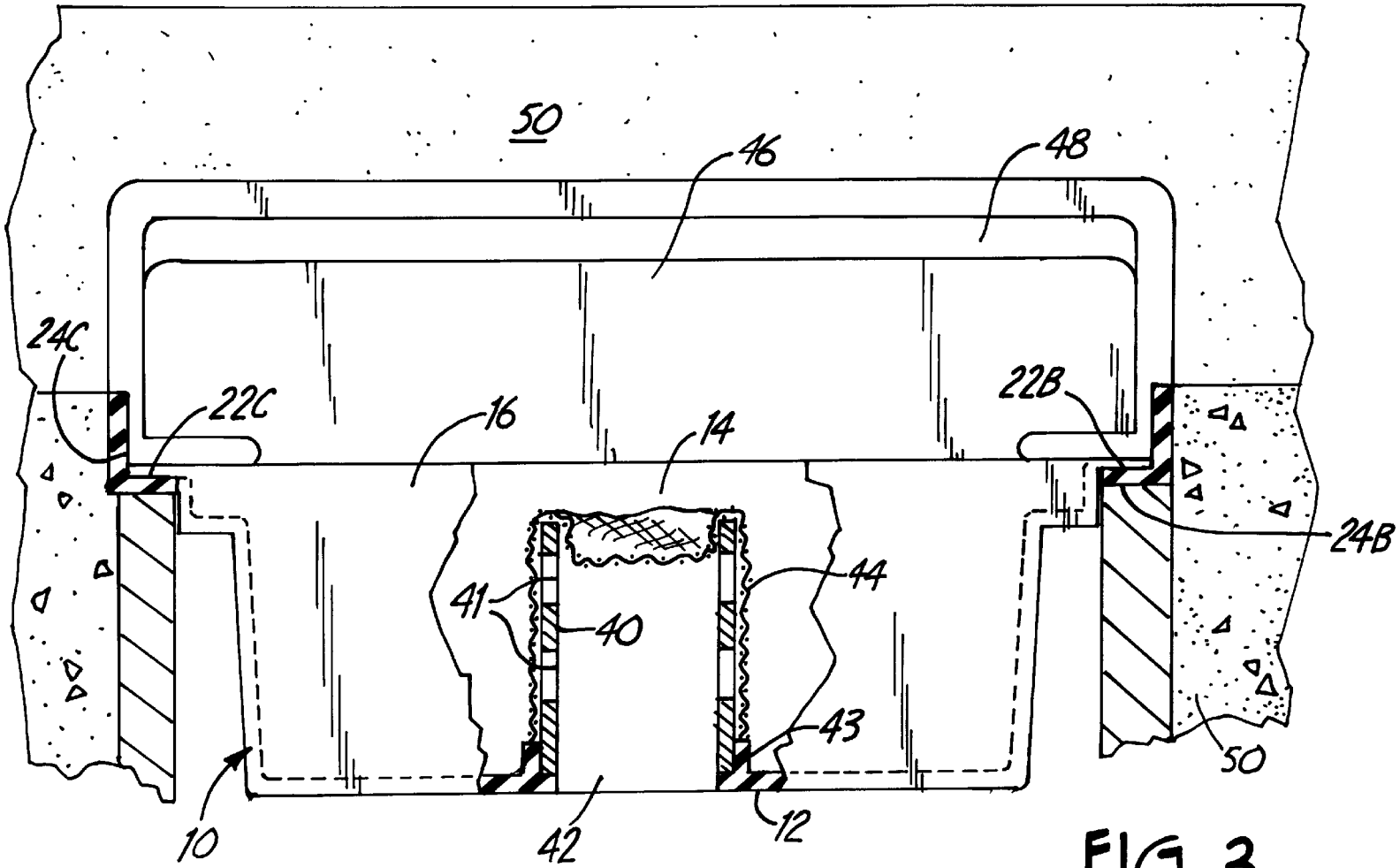
FIG. 3 is a front view of the catch basin of the present invention with parts broken away.

A catch basin forming an erosion control device is illustrated generally at 10, and made according to the present invention. The basin 10 is a open topped basin that has a bottom wall 12, a rear wall 14, a front wall 16, and side walls 18 and 20. The side walls and the front wall have flanges or lips 22 that are used for supporting the basin 10 in a frame 24 that is designed for containing a slated grate 25 for overlying the inlet to a storm sewer pipe shown schematically at 26. The frame 24 has a cross section shaped like an angle iron along the front and sides, and has a front member 24A that supports the flange 22A of the basin. The frame 24 has side members 24B and 24C which support flanges 22B and 22C. The rear cross member 26 of the frame 24 can be utilized. As shown a curb box 30 is part of the frame 24, and is made so that it will provide a shield wall 32 and an opening 34 leading into the storm sewer chamber 36.

The basin 10 has offset wall sections 28 between flanges 22B and 22C and the side walls that position the bottom wall 12 hold the bottom wall to be generally horizontal. A standpipe or drainpipe 40 is positioned to align over an opening 42 in the bottom wall 12. As shown the drainpipe 40 fits into a collar 43 formed on the bottom wall 12, and extends upwardly therefrom. The opening 42 at the bottom of the drain pipe 40 leads to the storm sewer pipe. The drainpipe 40 is a perforated plastic drain pipe with large holes 41 in it, and it is covered with a filter material or a filter sock 44 that is a mesh or other filter material that will filter out debris and sediment before the material enters into the interior of the drain 40. Water drains through the opening 42 into the storm sewer cavity 36.

The basin 10 can be made out of a suitable plastic material or formed metal, and the drainpipe 40 is then cemented in place or otherwise securely fastened. The collar 43 can be molded to the bottom wall 12, for holding the drainpipe in position, if desired.

The basin also has a sediment deflection wall shown at 46 at the rear or curb end. The plate 46 is offset from the rear wall with a flange 47 that can rest on frame cross member 26. The wall 46 fits into the inlet opening in the curb box 30 to partially block the opening. A space shown at 48 is left so that if serious flooding occurred, this space or gap would permit water to go through the curb box and into the storm sewer.

The top of the drain 40 is left uncovered, so that if water fills the basin it can overflow into the interior of the pipe, to take care of storms or excessive drainage.

When the curb and gutter is formed, which is shown in FIG. 1, at 50, it is made of concrete, and is hand formed around the curb box or other structure, after the frame 24 for the grate 25 has been put into place. In other words, the frame 24 is supported on the frame cross member 26, and the concrete curb and gutter 50 is formed around the frame.

The basin 10 is put into place on the frame 24 before the curb and gutter is formed, and if any concrete or sand, or the like from the formation of the curb is broken off or discarded, it will not go down the storm drain, but rather will be caught in the basin 10.

Additionally, runoff water that may be carrying debris or other materials will be prevented from going directly into the storm drain, by the standpipe 40 and filter sock 49 that is used in the basin 10.

The basin 10 forms an open topped receptacle, with the bottom wall, side walls, and front and rear walls as shown. The basin can be designed in shape so that it will fit into the various types of frames used for storm sewer grates, as well as the rectangular form shown. Storm sewer frame castings are available in many shapes and sizes, and each erosion control basin then would be designed to fit into the frame with which it is used.

The frame 24 for the drain is set into place on the previously installed storm sewer, and supported in place. Then the basin 10 is put into the frame 24, and is supported on the lips that extend around at least three walls. The rear wall of the basin can be supported on a cross member of the frame 24 as well. Then the curb and gutter 50 is formed around the frame for the storm drain, and the basin 10 acts as a trap for debris or material that may be loosened or dropped when the concrete work is being done.

The basin is permitted to stay in place until the landscaping is completed to collect debris, salt, and other material that may be washed into the drain opening. The basin can be removed and dumped if it fills. The basin is removed when construction is completed.

Although the present invention has been described with reference to preferred embodiments, workers skilled in the art will recognize that changes may be made in form and detail without departing from the spirit and scope of the invention.

What is claimed is:

1. An erosion control basin apparatus for a drain opening, the basin apparatus being mounted in a grate frame defining an upwardly facing opening used for a storm sewer grate, the drain opening including an upwardly extending portion at one side of the grate frame, said grate frame having supports thereon, the basin apparatus comprising a single open topped receptacle having walls joined together to form the receptacle, the receptacle walls fitting closely within the grate frame so the open top conforms in size to the grate frame opening in which it is placed, members on the basin apparatus for supporting the open topped receptacle on the supports on the grate frame, a deflection plate forming a portion of the basin apparatus supported relative to and on a side of the receptacle and positioned to shield flow of water through the upwardly extending portion of the drain opening, and a drain from the basin receptacle comprising an upright pipe supported within the basin receptacle and having an interior opening to an outlet in one of the walls of the basin receptacle, said upright pipe having a plurality of openings therethrough, and a filter surrounding said pipe and the openings in the pipe to permit liquid to be filtered through the filter before entering the interior of the pipe to exit from the opening at the outlet.

2. The erosion control basin apparatus of claim 1, wherein a bottom wall of the basin apparatus has a collar for receiving the pipe.

3. The erosion control basin apparatus of claim 1, wherein the basin apparatus is made of plastic.

4. The erosion control basin apparatus of claim 1, wherein the basin apparatus is made of metal.

5. The erosion control basin apparatus of claim 1, wherein the basin apparatus has flanges along sides thereof for supporting the basin on a grate frame.

6. An erosion control basin for mounting in a grate frame used for a storm sewer grate, said grate frame having support flanges thereon, the basin comprising a single open topped receptacle fitting in the grate frame and having a bottom wall, a front wall, a rear wall, and side walls joined together to form the receptacle, the front, rear and side walls being positioned adjacent to sides of the grate frame in which the basin is placed, and flange members on the side walls of the basin for supporting the basin on support flanges of the grate frame, a deflection plate supported relative to one side of the basin and positioned to deflect water into the basin, and a drain from the basin comprising an upright pipe within the open topped receptacle and having an interior forming a passageway opening to an outlet in the bottom wall of the receptacle, said upright pipe having a plurality of openings therethrough, and a filter surrounding said pipe and the openings in the pipe to permit liquid in the receptacle to be filtered through the filter before entering the interior of the pipe to exit from the opening at the outlet.

7. An erosion control basin for mounting in a grate frame used for a storm sewer grate, said grate frame having support flanges thereon, the basin comprising an open topped receptacle having a bottom wall, a front wall, a rear wall, and side walls joined together to form the receptacle, and flange members on selected walls of the basin for supporting the basin comprising an upright pipe within the open topped receptacle and having an interior forming a passageway opening to an outlet in the bottom wall of the receptacle, said upright pipe having a plurality of openings therethrough, a filter surrounding said pipe and the openings in the pipe to permit liquid in the receptacle to be filtered through the filter before entering the interior of the pipe to exit from the opening at the outlet, and a deflection plate attached to the rear wall along a flange that is substantially perpendicular to the rear wall, so the deflection plate is offset from the rear wall.

8. The erosion control basin of claim 7, wherein the basin is made of molded plastic.

9. The erosion control basin of claim 7, wherein the basin is made of metal.

10. A sediment control basin for mounting in a grate frame used for a storm sewer grate having a curb side, said frame having supports thereon, the basin comprising an open topped receptacle having walls comprising a front wall, a rear wall and side walls, and a bottom wall joining together to form the receptacle, and members on the basin for supporting the basin on the supports on the grate frame with the rear wall on curb side of the grate frame, the basin including a deflection plate extending upwardly from the rear wall of the basin a selected distance, and a drain from the basin comprising a pipe having an interior passageway opening to an outlet in one of the walls of the basin, said pipe having a plurality of openings therethrough, and a filter surrounding sail pipe and the openings in the pipe to permit liquid to be filtered through the filter before entering the interior passageway of the pipe and exiting from the outlets.

11. The sediment control basin of claim 10 wherein the grate frame includes a laterally facing opening extending above the supports on the curb side, the deflection plate at least partially covering the opening.

12. The erosion control basin of claim 10, wherein there is a flange on the rear wall that is substantially perpendicular to the rear wall, the deflection plate being attached to the flange of the deflection plate is offset from the rear wall.

* * * * *

UNITED STATES PATENT AND TRADEMARK OFFICE

CERTIFICATE OF CORRECTION

PATENT NO. : 6,609,852 B2
DATED : August 26, 2003
INVENTOR(S) : Brian J. Wimberger It is certified that error appears in the above-identified patent and that said Letters Patent is hereby corrected as shown below:

Column 4,
Line 52, change “sail” to -- said --.
Line 62, change “of” to -- so --.

Signed and Sealed this

Fourth Day of November, 2003

JAMES E. ROGAN
*Director of the United States Patent and Trademark Office*